US005080119A

United States Patent [19]

Scherer

[11] Patent Number: 5,080,119

[45] Date of Patent: Jan. 14, 1992

[54] TENT

[75] Inventor: Michael J. Scherer, Boulder, Colo.

[73] Assignee: American Recreation Products, Inc., St. Louis, Mo.

[21] Appl. No.: 379,635

[22] Filed: Jul. 13, 1989

[51] Int. Cl.[5] ..... E04H 15/40
[52] U.S. Cl. ..... 135/104; 135/105
[58] Field of Search ..... 135/104–105

[56] References Cited

U.S. PATENT DOCUMENTS

| | | | |
|---|---|---|---|
| 3,480,023 | 11/1969 | McConnell et al. | 135/104 |
| 4,003,181 | 1/1977 | Robinson et al. | 135/105 |
| 4,099,533 | 7/1978 | Gillis | 135/3/24 |
| 4,165,757 | 8/1979 | Marks | 135/104 X |
| 4,745,936 | 5/1988 | Scherer | 135/104 |
| 4,945,584 | 8/1990 | LaMantia | 135/104 X |

OTHER PUBLICATIONS

Title: Expedition, Author: Eureka! Tent, Year: 1988, Circled photograph. shows continuous frame sleeves.

*Primary Examiner*—David A. Scherbel
*Assistant Examiner*—Kien Nguyen
*Attorney, Agent, or Firm*—Senniger, Powers, Leavitt & Rodel

[57] ABSTRACT

A tent comprising a fabric shell supported by a skeleton frame having at least two criss-crossing ribs. The tent has first and second criss-crossing sleeves for receiving the ribs. Each sleeve defines a closed, uninterrupted passage having at least one open end for the continuous, uninterrupted insertion of a respective rib into the sleeve. At least one of the sleeves is positioned below one of the other sleeves at the location where the sleeves criss-cross so that the passages defined by the sleeves do not intersect. The improvement comprises the sleeves being secured in fixed position relative to one another generally at the location where their respective ribs criss-cross thereby to stabilize the sleeves relative to one another and to the shell.

14 Claims, 2 Drawing Sheets

FIG. 1.
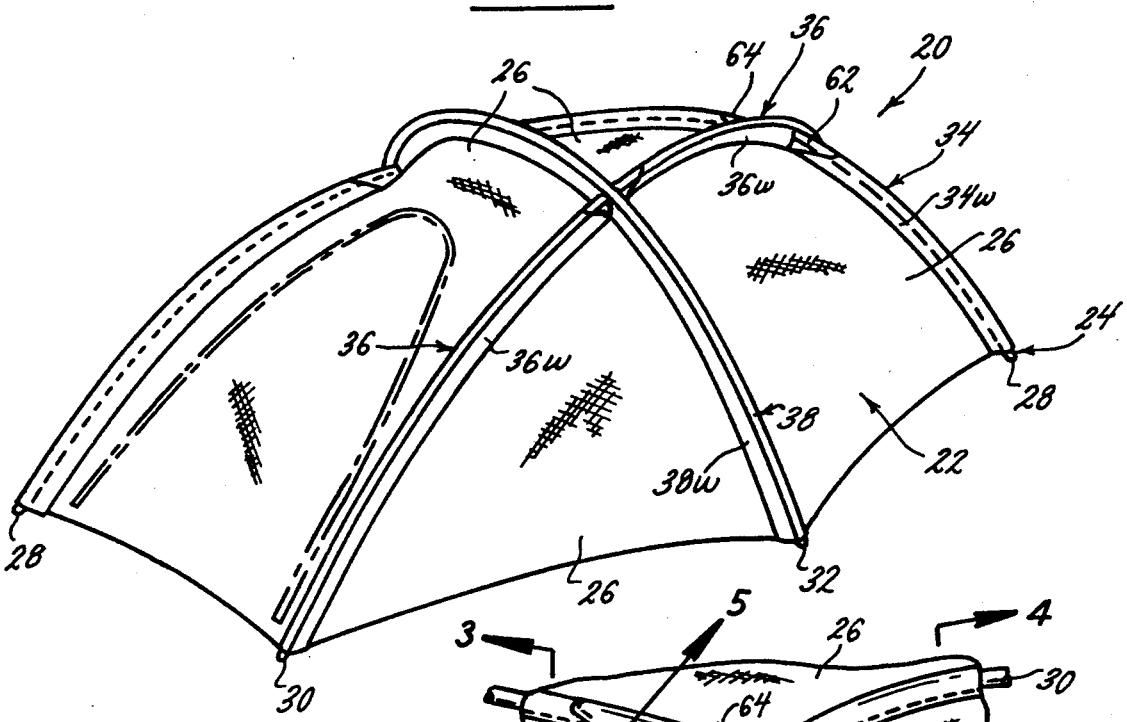
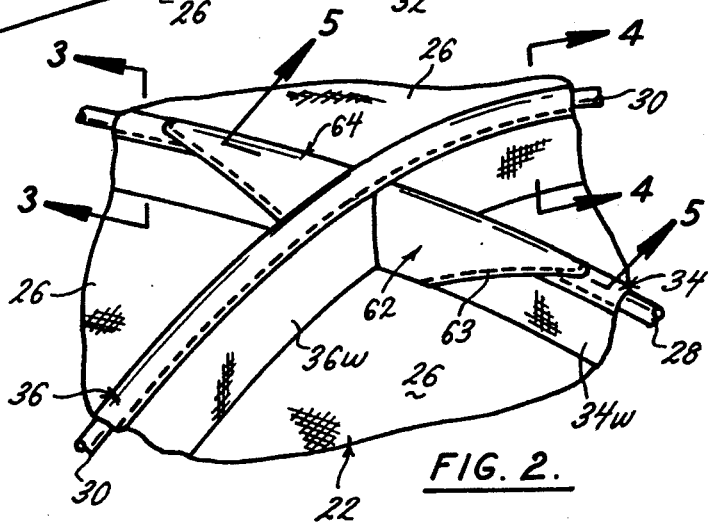
FIG. 2.
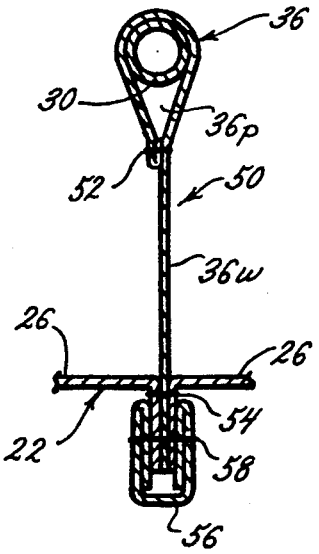
FIG. 4.
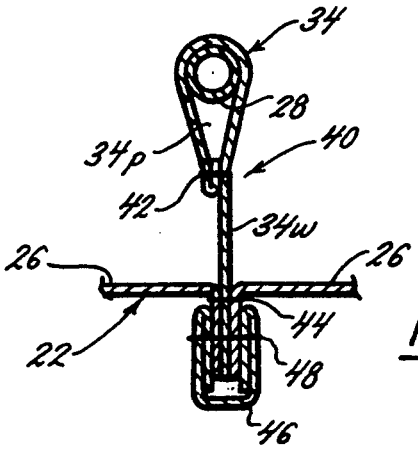
FIG. 3.

TENT

BACKGROUND OF THE INVENTION

This invention relates generally to tents, and in particular to tents of the type having a fabric shell supported by a skeleton frame.

Tents of the type having skeleton frames are made in a wide variety of shapes and constructions, including cabin tents and domed tents. The skeleton frame is usually positioned around the exterior of the fabric shell, although it is sometimes positioned inside of the shell. The frame typically comprises at least two criss-crossing ribs which extend through a plurality of loops or sleeves in the tent. Threading the ribs through these loops or sleeves to erect the tent can be difficult and time consuming. The ends of the ribs must be aligned with each loop or sleeve as the rib is advanced. Mistakes are often made by inserting the rib into the wrong loop or sleeve, particularly in the areas where the ribs criss-cross, requiring the rib to be removed and reinstalled. As more of the ribs are installed, the tent becomes increasingly difficult to manipulate. The person trying to erect the tent must try to simultaneously support the tent, align the rib end with the loop or sleeve, and advance the rib. The person usually has to move from one side of the tent to the other as each rib is advanced, and previously installed ribs often obstruct the insertion of subsequent ribs. Attempts have been made to solve this problem by providing continuous sleeves for the ribs, but because of the way these sleeves have been attached to the shell erecting the tent still can be difficult and the ribs generally must be installed in a particular order. Thus, it is an effort for one person working alone to erect a tent, and there can be problems even if more than one person is available.

SUMMARY OF THE INVENTION

It is among the objects of the present invention to provide a tent of the type having a fabric shell supported by a skeleton frame of criss-crossing ribs which is easy to erect, and in particular to provide such a tent in which the ribs can be easily installed on the shell in any order. It is also an object of the present invention to provide such a tent in which each rib can be installed and removed from one side of the tent. It is further among the objects to provide such a tent which is compact, lightweight and has a minimum of parts, for easy storage and handling; to provide such a tent which is suitable for transport when backpacking; and to provide such a tent which is of relatively simple and inexpensive construction.

Generally, the tent of the present invention comprises a fabric shell supported by a skeleton frame having at least two criss-crossing ribs. Depending upon the type of tent, these ribs may be rigid, resilient, or they may comprise a combination of rigid and resilient portions. The tent includes first and second criss-crossing sleeves for receiving the ribs. Each sleeve defines a closed, uninterrupted passage having at least one open end for the continuous, uninterrupted insertion of a respective rib into he sleeve. The first sleeve is positioned below the second sleeve at the location where the sleeves criss-cross so that the passage defined by the sleeves do not intersect. The tent further includes means for securing the sleeves in fixed position relative to one another generally at the location where the sleeves criss-cross to stabilize the sleeves relative to one another and to the shell.

Thus, in the tent of the present invention, the ribs can be inserted into the sleeves without being obstructed by breaks in the sleeves' passages or by other ribs, making erection of the tent faster and easier. Because the Passages are continuous, each rib can be inserted into its corresponding sleeve from one side of the tent, minimizing the need to manipulate the tent at various points around the tent. It has been found that securing the criss-crossing sleeves in fixed position at the locations where they criss-cross and/or securing the sleeves to the shell at those points stabilizes the sleeves making it easier to insert the ribs into the sleeves and eliminating the need to install the ribs in any particular order thereby simplifying erection of the tent. The tent of the present invention does not require any additional parts or hardware, and can be collapsed to a relatively compact and lightweight form that is easy to store and handle. Finally, the tent is of relatively simple and inexpensive construction.

These and other advantages will be in part apparent and in part pointed out hereinafter.

BRIEF DESCRIPTION OF THE DRAWINGS

FIG. 1 is a perspective view of a tent constructed according to the principles of this invention;

FIG. 2 is an enlarged partial perspective view of the tent showing two criss-crossing sleeves;

FIG. 3 is a transverse cross-sectional view taken along the plane of line 3—3 of FIG. 2, showing one of the sleeves and its respective web;

FIG. 4 is a transverse cross-sectional view taken along the plane of line 4—4 of FIG. 2, showing another of the sleeves and its respective web;

Corresponding reference numerals indicate corresponding parts throughout the several views of the drawings.

DETAILED DESCRIPTION OF THE PREFERRED EMBODIMENT

Figure 5:
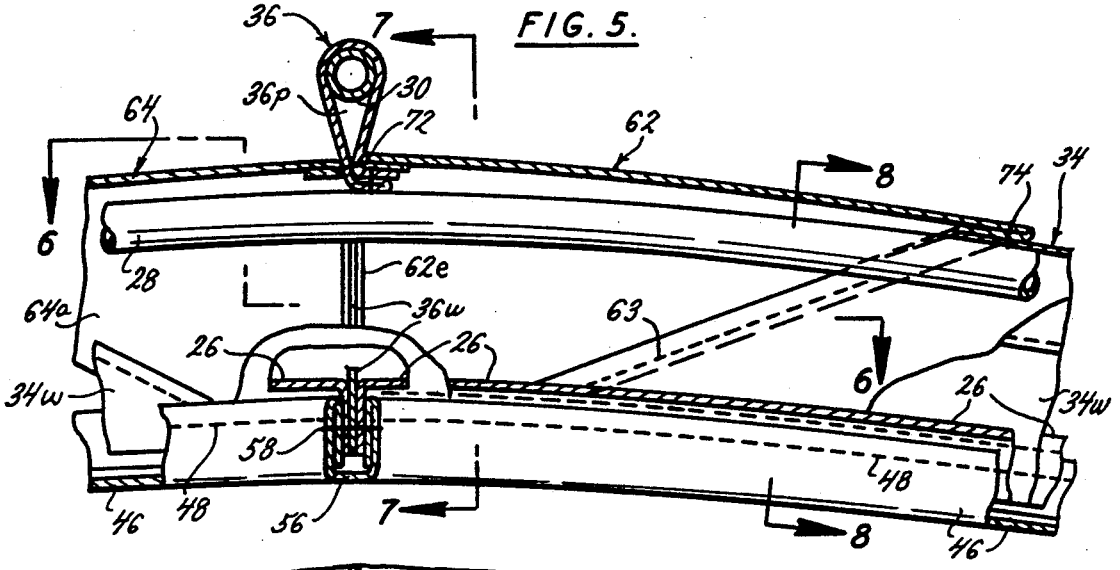
FIG. 5 is a cross-sectional view taken along the plane of line 5—5 of FIG. 2, slightly forward of the lower rib, showing two criss-crossing sleeves.

A tent constructed according to the principles of this invention, indicated generally as 20, is shown in FIG. 1. The tent 20 comprises a fabric shell generally designated 22 supported by a skeleton frame generally designated 24. As used herein, the term fabric shell includes any flexible sheet material suitable for use in a tent. In this preferred embodiment the tent 20 is dome-shaped, but the present invention is not so limited, and is applicable to any tent of the type comprising a flexible shell supported by a skeleton frame.

The shell 22 comprises a plurality of panels 26. As illustrated, the skeleton frame 24 comprises three flexibly resilient ribs (or poles) 28, 30, and 32 which criss-cross. However, it will be understood that these ribs may be configured differently; there may be fewer or more ribs; or the ribs may be constructed differently, for example being rigid or comprising a combination of rigid and flexibly resilient portions. As is well known in the art, the resilient ribs 26, 28, and 30 each may comprise a plurality of sections connected by a plurality of socket members with a resilient cord extending through the sections to hold the sections together yet permitting them to be removed from their sockets and folded for compact storage and handling.

The ribs 28, 30, 32 are received in sleeves 34, 36, and 38, respectively, which form criss-crossing arches above the exterior side of the shell 22. Each sleeve (which may be broadly referred to as sleeve means) extends in a generally arcuate path from one point at the base of the tent 20 to a corresponding opposite point at the base of the tent. The tent 20 further comprises elongate webs 34*w*, 36*w*, and 38*w*, which extend between and connect sleeves 34, 36, and 38, respectively. The sleeves 34, 36, and 38 define closed, uninterrupted passages 34*p*, 36*p*, and 38*p*, respectively, open at least one end and sized for receiving the ribs 28, 30, and 32, respectively. These passages do not intersect at the junctions where the sleeves criss-cross; instead one sleeve passes under the other, through the other's web. The sleeves are connected to the webs through which they extend at the junctions where the sleeves criss-cross so that the webs support and stabilize the sleeves. Such connection of the sleeves to the webs constitute means for securing the sleeves in fixed position relative to one another generally at the junction where the sleeves criss-cross. This construction of the passages 34*p*, 36*p*, and 38*p* permits the continuous, uninterrupted insertion of the corresponding ribs into the sleeves.

FIGS. 2–8 illustrate in greater detail the construction of sleeves 34 and 36 adjacent the junction where they criss-cross. This construction is representative of the construction of the other sleeves at the points where they criss-cross one another.

Each sleeve and its respective web may be formed integrally. For example, as shown in FIG. 3, sleeve 34 and its respective web 34*w* are formed from an elongate strip of material 40, the top edge of which is folded over on itself and secured with stitching 42 to form the web 34*w* and the passage 34*p*. The bottom edge margin of strip 40 is secured between overlapping edge margins of two adjacent panels 26 forming the shell 22, and secured with stitching 44. A binding 46 is secured over the seam thus formed by stitching 48. The material from which the sleeves and webs are made may be an open mesh woven nylon fabric or some other suitable material. The material is preferably resilient and adapted to stretch in at least one direction, i.e., a direction generally perpendicular to the sleeve and the shell to permit the web to stretch to accommodate changes in the distance between the sleeves and the shell.

As shown in FIG. 4, sleeve 36 and its respective web 36*w* are similarly formed from an elongate strip of material 50, the top edge of which is folded over on itself and secured by stitching 52 to form the web 36*w* and the passage 36*p*. The bottom edge of strip 50 is secured by stitching 54 between the overlapping marginal edges of two adjacent panels 26 forming the shell 22. A binding 56 is secured over the seam thus formed by stitching 58. It will be apparent that sleeve 38 and its web 38*w* may be similarly constructed.

Figure 6:
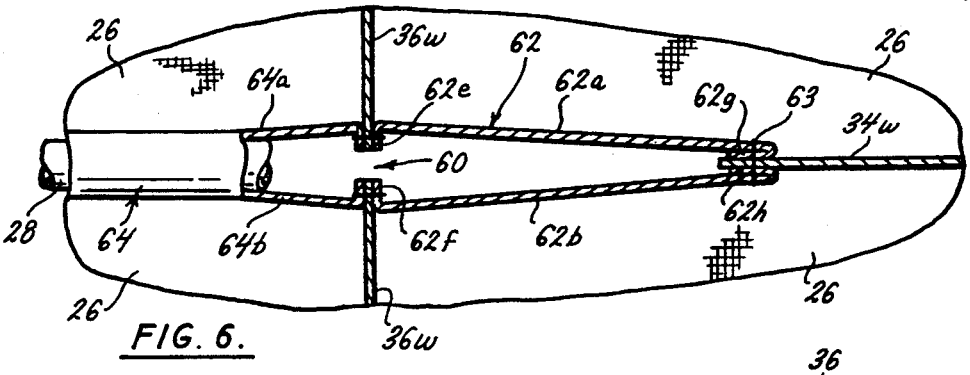
FIG. 6 is a cross-sectional view taken along line 6—6 of FIG. 5 showing the construction of the criss-crossing sleeves.
Figure 8:
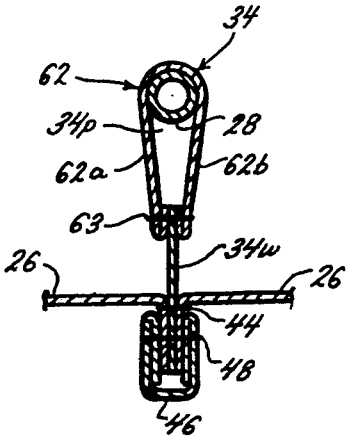
FIG. 8 is a cross-sectional view taken along the plane of line 8—8 of FIG. 5 showing the construction of the criss-crossing sleeves.
Figure 7:
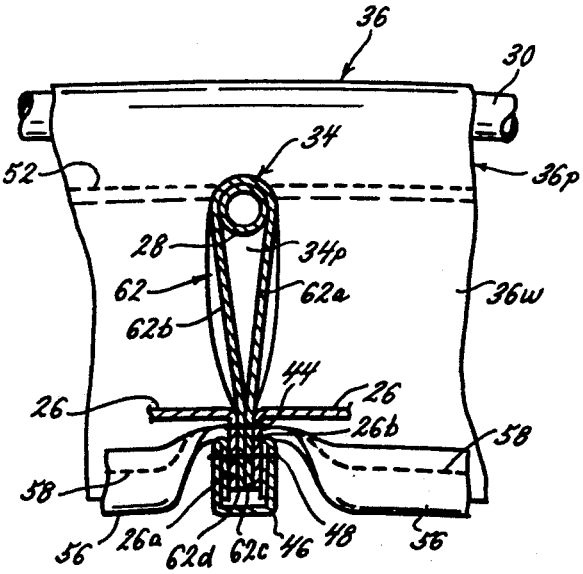
FIG. 7 is a cross-sectional view taken along the plane of line 7—7 of FIG. 5 showing the construction of the criss-crossing sleeves.

In the junction where the sleeves criss-cross, the construction of the sleeves and the webs differs so that the passage defined by one of the sleeves (constituting the first sleeve or inner sleeve) can extend underneath the passage defined by the other sleeve (constituting the second sleeve or outer sleeve), the lower passage passing through the web of the upper sleeve. For example, in the criss-cross formation illustrated in FIGS. 2 and 5–8, the passage 34*p* of sleeve 34 extends underneath passage 36*p* of sleeve 36, through web 36*w*. An opening 60, extending substantially from sleeve 36 to shell 22*a*, is provided in web 36*w*. In the area adjacent web 36*w* sleeve 34 is formed by two separate sleeve sections 62, 64 disposed on opposite sides of the web, the sections being attached to opposite faces of the web 36*w* in alignment with the opening 60. Such construction constitutes means for attaching sleeve 34 to web 36*w*. Thus, the sections 62, 64 are secured together in generally end-to-end relation with the web 36*w* sandwiched between and secured to the sections 62, 64. As shown in FIGS. 6 and 7, these sleeve sections 62, 64 are formed from panels of material folded into loops of inverted U-shape cross-section having opposing walls 62*a*, 62*b*, and 64*a*, 64*b*, respectively, which define between them enlarged portions of passage 34*p*. The two side walls of each loop have bottom edge margins 62*c*, 62*d* disposed in face-to-face relation and secured by stitching 44 between the depending edge margins 26*a*, 26*b* of adjacent tent panels 26. The seam thus formed, together with the ends of binding strips 56, are secured in binding 46. The side walls of each sleeve section also have a first pair of generally vertical end edge margins 62*e*, 62*f* attached by stitching to the web 36*w* on opposite sides of the opening 60, and a second pair of inclined end edge margins 62*g*, 62*h* attached to web 34*w* and sleeve 34 by a line of stitching 63 sloping upwardly from the panels 2*a* 6 of the tent toward the smaller diameter portion of passage 34*p* in sleeve 34, the latter stitching 63 being engageable by the end of a rib being inserted through the sleeve section for guiding the rib up into the smaller diameter portion of sleeve passage 34*p*. The sleeve sections 62*a*, 64 are further secured by stitching 72*a* to the bottom of sleeve 36 and by stitching 74 to the top of sleeve 34. Attaching sleeve sections 62, 64 to web 36*w* at the location where passage 34*p* criss-crosses 36*p* increases the strength and rigidity of the tent 20.

OPERATION

In the erection of the tent shown and described in the preferred embodiment, the floor of the tent 20 is laid flat over the area where the tent is to be erected with the flexible shell 22 collapsed over the floor. One end of one of the ribs, for example rib 30, is inserted into one end of its corresponding sleeve 36. The rib 30 is then advanced through passage 36*p* until the end of the rib 30 reaches the opposite end of the sleeve 36. As the rib 30 is advanced through the passage 36*p* the sleeve 36 causes the rib 30 to arch, thereby forming an inverted U-shaped bow member. The other ribs are then inserted through their respective sleeves in a similar manner. For example, rib 28 may then be advanced through sleeve 34. Rib 28 passes uninterrupted through passage 34*p*, even at the junction where rib 28 criss-crosses rib 30, because sleeve 34 extends below sleeve 36, through web 36*w*.

Because the passages in the sleeves are continuous, the rib ends do not have to be continuously monitored and aligned with loops as in prior art tent constructions nor do previously installed ribs interfere with the installation of additional ribs. Because of the attachment of the sleeves to each other and/or to the shell in the locations where the ribs criss-cross, the sleeves are stabilized; so installing the ribs is easier and the order of installation is unimportant. Thus, the tent is easier to erect and the person erecting the tent can advance each rib through its corresponding sleeve from one side of the tent without moving around the tent to manipulate the ribs.

The tent and ribs of the present invention are compact and lightweight. They require no additional loose parts or hardware that could be lost and they can be collapsed to a relatively lightweight and compact form for easy storage and handling. The attachment of the sleeves at the junction where they criss-cross stabilizes each sleeve relative to each other to prevent damage to the tent in wind.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An improved tent of the type comprising a fabric shell supported by a skeleton frame having at least two criss-crossing ribs, the tent including first and second criss-crossing sleeves for receiving the ribs, each sleeve defining a closed, uninterrupted passage having at least one open end for continuous, uninterrupted insertion of a respective rib into the sleeve, the first sleeve being positioned below the second sleeve at a location where the sleeves criss-cross so that the passages defined by the sleeves do not intersect, the improvement comprising:

means located where the sleeves criss-cross for securing the sleeves in fixed position relative to one another generally at the location where the sleeves criss-cross thereby to stabilize the sleeves relative to one another and to the shell, the means for securing the sleeves in fixed position relative to one another comprising a web connecting the second sleeve to the shell of the tent and means for attaching the first sleeve to the web with the first sleeve passing through the web.

2. The improved tent according to claim 1 wherein the first sleeve comprises at least two separate sleeve sections secured together in end-to-end relation, with the web of the second sleeve sandwiched between and secured to the two separate sleeve sections.

3. The improved tent according to claim 1 wherein the web comprises a resilient material adapted to stretch.

4. An improved tent of the type comprising a fabric shell supported by a skeleton frame having at least two criss-crossing ribs, the tent including a plurality of sleeves each defining a closed uninterrupted passage for receiving one of the ribs, the sleeves forming at least one sleeve junction where at least two sleeves criss-cross so their respective ribs criss-cross, one of the sleeves, constituting an inner sleeve, extending inwardly of the other sleeve, said other sleeve constituting an outer sleeve, at the sleeve junction so that the passages defined by the sleeves do not intersect, the improvement comprising:

a web between the outer sleeve and the fabric shell at the junction having an opening through which the inner sleeve extends, the inner sleeve being secured in fixed position relative to the web thereby to stabilize the sleeves relative to one another and to the shell.

5. The improved tent according to claim 4 wherein the inner sleeve comprises at least two separate sleeve sections, one on either side of the web at the junction.

6. The improved tent according to claim 4 wherein the opening extends substantially from the outer sleeve to the shell and wherein the inner sleeve in a region adjacent the junction comprises first and second sections attached on opposite sides of the web and in alignment with the opening, each sleeve sections being folded on itself into an inverted U-shape cross-section and attached at one end to marginal edges of the opening.

7. A tent having a fabric shell and first and second sleeve means which, upon erection of the tent, extend in criss-crossing arches with the first and second sleeve means extending, respectively, from first and second points adjacent a lower edge of the tent to corresponding opposite points adjacent the lower edge of the tent, each sleeve means being open at one end thereof for the insertion therein of a rib for supporting the tent, the first sleeve means comprising a first sleeve defining a first generally continuous passage and a web interposed between the first sleeve and the fabric shell for securing the first sleeve to the fabric shell, the first passage being substantially continuous from the first point to the corresponding opposite point, the second sleeve means comprising a second sleeve defining a second generally continuous passage and secured to the fabric shell, the second passage criss-crossing with but not in communication with the first passage and extending through said web, the second passage being substantially continuous from the second point to the corresponding opposite point, the first sleeve means being secured in fixed position relative to the second sleeve means at a location where the passages criss-cross thereby to stabilize the sleeves relative to one another and to the shell.

8. The tent according to claim 7 wherein the second sleeve means is formed by at least two separate sleeve sections, one on either side of the first sleeve means at the location where the sleeve means criss-cross.

9. The tent according to claim 7 wherein at least one of the sleeve means is positioned above the fabric shell.

10. A sleeve junction construction for a tent of the type comprising a fabric shell supported by a skeleton frame having at least two criss-crossing ribs, the tent including a plurality of sleeves each defining a closed uninterrupted passage for receiving one of the ribs, the sleeves forming at least one sleeve junction where at least two sleeves criss-cross so their respective ribs criss-cross with one of the sleeves, constituting an inner sleeve, extending inwardly of the other sleeve, said other sleeve constituting an outer sleeve, at the junction so that the passages defined by the sleeves do not intersect, the sleeve junction construction comprising an outer web extending between the outer sleeve and the shell at the junction, the inner sleeve extending through and being secured to the outer web.

11. The sleeve junction construction according to claim 10 wherein the inner sleeve in a region adjacent the junction comprises first and second sleeve sections attached on opposite sides of the outer web, each sleeve section being folded on itself into an inverted U-shape and attached to the fabric shell.

12. An improved tent of the type comprising a fabric shell supported by a skeleton frame having at least two criss-crossing ribs, the tent including a plurality of sleeves each defining a closed uninterrupted passage for receiving one of the ribs, the sleeves forming at least one sleeve junction where at least two sleeves criss-cross so their respective ribs criss-cross, one of the sleeves, constituting an inner sleeve, extending inwardly of the other sleeve, said other sleeve constituting an outer sleeve, at the junction so that the passages defined by the sleeves do not intersect, an elongate outer web attached along one longitudinal edge, constituting an outer edge of the web, to the outer sleeve and along a second longitudinal edge, constituting an inner edge of the web, to the shell, and an elongate inner web attached along one longitudinal edge, constituting an outer edge of the inner web, to the outer sleeve and along a second longitudinal edge, constituting an inner edge of the inner web, to the shell, the improvement comprising:

an opening in the outer web extending substantially from the outer sleeve to the shell, and first and second sleeve members forming the inner sleeve in a region adjacent the outer web, said sleeve members being attached on opposite sides of the outer web in alignment with said opening, each sleeve member being folded on itself to form a generally inverted U-shaped cross section and being attached at one end to margins of the sides and top of the opening in the outer web and at the other end to the inner sleeve and inner web.

13. The improved tent according to claim 12 wherein the shell is comprised of a plurality of panels, and wherein the inner edge of the outer web extends into and is attached to a seam formed by adjacent panels.

14. The improved tent according to claim 12 wherein the shell is comprised of a plurality of panels, and wherein the sleeve members are attached to a seam formed by adjacent panels.

* * * * *